United States Patent [19]

Naruse et al.

[11] Patent Number: 4,986,083

[45] Date of Patent: Jan. 22, 1991

[54] FREEZER MACHINE

[75] Inventors: Nobutaka Naruse, Toyoake; Akihiko Hirano, Kariya; Katsunobu Minari, Nagoya, all of Japan

[73] Assignee: Hoshizaki Denki Kabushiki Kaisha, Toyoake, Japan

[21] Appl. No.: 487,010

[22] Filed: Mar. 1, 1990

[30] Foreign Application Priority Data

Mar. 1, 1989 [JP] Japan ..... 1-49230

[51] Int. Cl.[5] ..... G05D 23/32

[52] U.S. Cl. ..... 62/157; 62/83; 62/196.4; 62/233

[58] Field of Search ..... 62/157, 158, 196.4, 62/231, 233, 83, 278, 238.5, 352, 155, 225

[56] References Cited

U.S. PATENT DOCUMENTS

| | | | |
|---|---|---|---|
| 3,855,812 | 12/1974 | Linstromberg | 62/233 X |
| 3,885,937 | 5/1975 | Norros | 62/233 X |
| 4,644,756 | 2/1987 | Sugimoto et al. | 62/225 X |
| 4,697,431 | 10/1987 | Alsenz | 62/157 X |

*Primary Examiner*—Harry B. Tanner

*Attorney, Agent, or Firm*—Armstrong, Nikaido, Marmelstein, Kubovcik & Murray

[57] ABSTRACT

In a freezer machine having a refrigeration system in the form of a circulation circuit including a compressor, a condenser, an evaporator coil arranged for thermal exchange with a freezing receptacle, and a solenoid valve of the normally closed type disposed within a bypass circuit of the circulation circuit to supply therethrough the hot gas outflowing from the compressor directly into the evaporator coil when it has been energized, an electric control circuit for the freezer machine is designed to repeatedly measure a first predetermined period of time, for instance four hours, in a condition where said compressor is being deactivated, to measure a second predetermined period of time, for instance three minutes, upon each lapse of the first predetermined period of time and to activate the compressor for the second predetermined period of time upon each lapse of the first predetermined period of time and energize the solenoid valve in response to activation of the compressor.

2 Claims, 1 Drawing Sheet

FREEZER MACHINE

BACKGROUND OF THE INVENTION

1. Field of the Invention

The present invention relates to a freezer machine adapted for use in ice making machines, refrigerators or the like.

2. Discussion of the Prior Art

In the refrigeration system of conventional freezer machines, a solenoid valve of the normally closed type is disposed within a bypass line of the refrigeration circulation circuit to supply therethrough the hot gas outflowing from the refrigerant compressor directly into the evaporator coil when the solenoid valve has been energized. Such an arrangement of the solenoid valve is useful to dissolve the external surfaces of frozen ice cubes for removal of them from the freezing receptacle. It has been, however, found that during the freezing cycle, the compressed gaseous refrigerant from the compressor leaks out from the solenoid valve and is liquified in the course of lapse of time. The liquified refrigerant flows into the evaporator coil and is confined therein. When accumulated in the evaporator coil, the liquified refrigerant flows into the compressor from the evaporator coil in restart of the freezing cycle, causing unexpected trouble of the compressor.

In the case that an accumulator is disposed in a line between the evaporator coil and compressor to store the liquified refrigerant flowing therein from the evaporator coil, the amount of gaseous refrigerant to be circulated into the compressor will decrease in accordance with an increase of the liquified refrigerant in the accumulator. This results in deterioration of the freezing performance of the freezer machine. In addition, such an arrangement of the accumulator results in an increase of manufacturing cost of the freezer machine.

SUMMARY OF THE INVENTION

It is, therefore, a primary object of the present invention to provide an improved freezer machine capable of eliminating accumulation of the liquified refrigerant in the evaporator coil without such additional component parts as described above.

According to the present invention, the primary object is attained by providing a freezer machine which has a refrigeration system in the form of a circulation circuit including a compressor, a condenser, an evaporator coil arranged for thermal exchange with a freezing receptacle, and a solenoid valve of the normally closed type disposed within a bypass circuit of the circulation circuit to supply therethrough the hot gas outflowing from the compressor directly into the evaporator coil when it has been energized, wherein an electric control circuit for the freezer machine comprises first means for repeatedly measuring a first predetermined period of time, for instance four hours, in a condition where the compressor is being inoperative, second means for measuring a second predetermined period of time, for instance three minutes, upon each lapse of the first predetermined period of time, and third means for activating the compressor for the second predetermined period of time upon each lapse of the first predetermined period of time and for energizing the solenoid valve in response to activation of the compressor.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
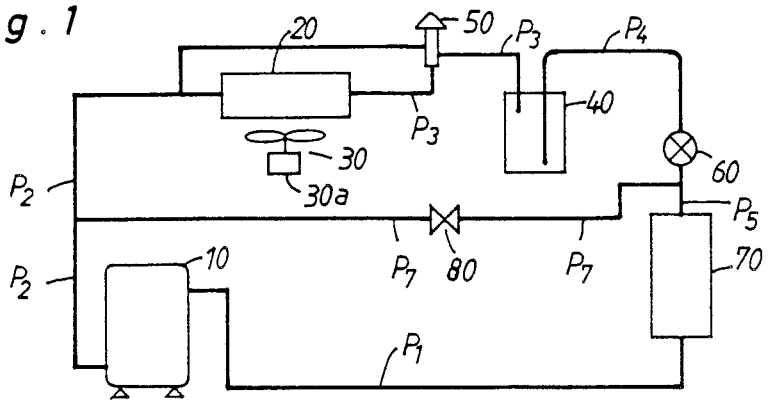
FIG. 1 is an illustration of a refrigeration system of a freezer machine.

Referring now to the drawings, there is illustrated a refrigeration system of a freezer machine adapted for use in an ice making machine. The refrigeration system includes a refrigerant compressor 10 driven by an electric motor 10a to compress a gaseous refrigerant applied thereto from a refrigerant return line $P_1$ and deliver it through an output line $P_2$ to a finned condenser 20 provided with a cooling fan or blower 30 driven by an electric motor 30a. The condenser 20 cools and liquifies the refrigerant and passes it through a line $P_3$ to a receiver 40 which acts to separate a gaseous phase component from the refrigerant thereby to apply only the liquid phase component of the refrigerant to a line $P_4$. Disposed in the line $P_3$ is a pressure control valve 50 which controls the pressure of liquified refrigerant in line $P_3$ to a proper level in accordance with the pressure in line $P_2$. An expansion valve 60 is connected at its inlet to the line $P_4$ to expand the liquid refrigerant and supply it into an evaporator coil 70 through a line $P_5$. The evaporator coil 70 is arranged for thermal exchange with a freezing receptacle in a manner quite conventional in the art. The refrigerant return line $P_1$ leads from the evaporator coil 70 back to the inlet of refrigerant compressor 10. A hot gas bypass line $P_7$ is connected at its one end to the line $P_2$ between compressor 10 and condenser 20 and at its other end to the line $P_5$ between expansion valve 60 and evaporator coil 70. A solenoid valve 80 of the normally closed type is disposed in the hot gas bypass line $P_7$ to supply therethrough the hot gas under high pressure outflowing from the compressor 10 directly into the evaporator coil 70 when it has been energized to dissolve fronzen ice cubes for removal of them from the receptacle.

Figure 2:
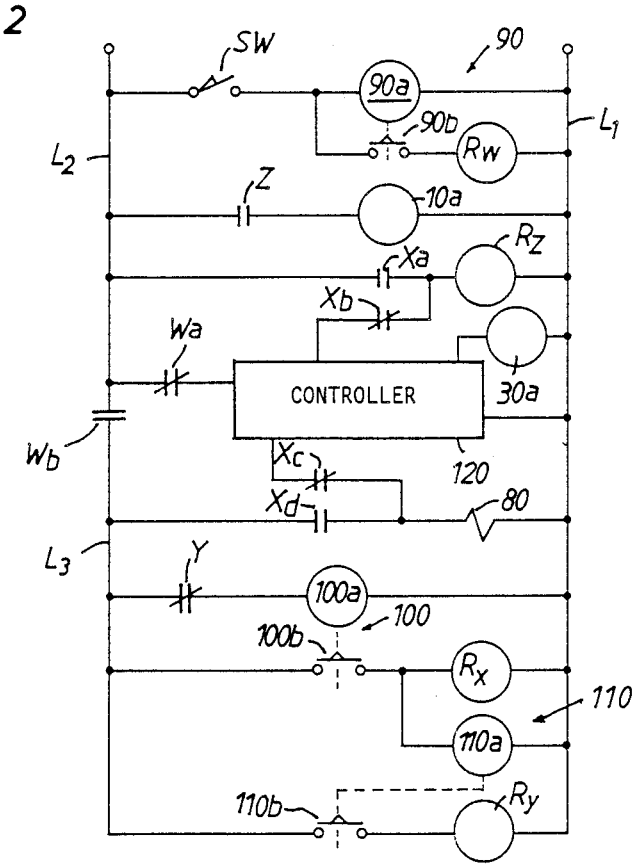
FIG. 2 is an electric control circuit for the refrigeration system.

In this embodiment, the freezer machine comprises an electric control circuit designed to activate the compressor 10 at least one time upon each lapse of a predetermined period of time, for instance four hours, after the compressor 10 has been deactivated and to energize the solenoid valve 80 in response to activation of the compressor 10. As illustrated in FIG. 2, the electric control circuit includes a detection switch SW of the normally open type arranged to be closed when an ice stocker of the ice making machine is fully filled with the ice cubes. A first timer circuit 90 is composed of a timer 90a associated with a normally open switch 90b. The timer 90a is connected at its one end to a common line $L_1$ and at its other end to a common line $L_2$ through the detection switch SW. When the detection switch SW is closed, the timer 90a is activated by the electric power applied thereto from the common lines $L_1$, $L_2$ to operate for a first predetermined period of time $t_1$. Upon lapse of the first predetermined period of time $t_1$, the timer 90a acts to close the normally open switch 90b. When the detection switch SW is opened, the timer 90a is deactivated to open the associated switch 90b. A relay coil Rw is associated with a normally closed relay switch Wa and a normally open relay switch Wb. The relay coil Rw is connected at its one end to the common line $L_1$ and at its other end to the common line $L_2$ through the normally open switch 90b and detection switch SW. When the normally open switch 90b is closed after lapse of the first predetermined period of time $t_1$, the relay coil Rw is energized to open the normally closed relay switch Wa and to close the normally open relay switch Wb.

The electric control circuit includes a second timer circuit 100 which is composed of a timer 100a associated with a normally open switch 100b. The timer 100a is connected at its one end to the common line $L_1$ and at its other end to the common line $L_2$ through a normally closed relay switch Y, a common line $L_3$ and the normally open relay switch Wb. When the relay switch Wb is closed by energization of the relay coil Rw, the timer 100a is activated to operate for a second predetermined perior of time $t_2$, for instance four hours. Upon lapse of the second predetermined period of time $t_2$, the timer 100a acts to close the normally open switch 100b. When the normally closed relay switch Y is opened, the timer 100a is deactivated to open the associated switch 100b. A third timer circuit 110 is composed of a timer 110a associated with a normally open switch 110b. The timer 110a is connected at its one end to the common line $L_1$ and at its other end to the common line $L_3$ through the normally open switch 100b. When the normally open switch 100b is closed after lapse of the second predetermined period of time $t_2$, the timer 110a is activated to operate for a third predetermined period of time $t_3$, for instance three minutes. Upon lapse of the third predetermined period of time $t_3$, the timer 110a acts to close the normally open switch 110b. When the normally open switch 100b is opened, the timer 110a is deactivated to open the associated switch 110b.

In the electric control circuit, a relay coil Rx is associated with normally open relay switches Xa, Xd and normally closed relay switches Xb, Xc. The relay coil Rx is connected in parallel with the timer 110a. When the normally open switch 100b is closed after lapse of the second predetermined period of time $t_2$, the relay coil Rx is energized to close the normally open relay switches Xa and Xd and to open the normally closed relay switches Xb and Xc. The normally closed relay switch Y is associated with a relay coil Ry which is connected at its one end to the common line $L_1$ and at its other to the common line $L_3$ through the normally open switch 110b. When the normally open switch 110b is closed after lapse of the third predetermined period of time $t_3$, the relay coil Ry is energized to open the normally closed relay switch Y.

The electric control circuit further includes a relay coil Rz associated with a normally open relay switch Z which is connected in series with the electric motor 10a for compressor 10. The relay coil Rz is connected at its one end to the common line $L_1$ and at its other end to the common line $L_2$ through the normally open relay switch Xa. When the normally open relay switch Xa is closed by energization of the relay coil Rx, the relay coil Rz is energized to close the normally open relay switch Z thereby to activate the electric motor 10a for compressor 10. The electric motor 30a for cooling fan 30 is connected at its one end to the common line $L_1$ and at its other end to a controller 120. The solenoid valve 80 is connected at it one end to the common line $L_1$ and at its other end to the control circuit 120 through the normally closed relay switch Xc. The controller 120 is connected at its one end to the common line $L_1$ and at its other end to the common line $L_2$ through the normally closed relay switch Wa. When the relay switch Wa is maintained in its closed position, the controller 120 is activated to energize the electric motors 10a and 30a for effecting freezing operation of the freezer machine and to maintain the solenoid valve 80 in its deenergized condition during the freezing operation.

Assuming that the ice stocker of the ice making machine has been fully filled with ice cubes, the detection switch SW is closed to activate the timer 90a. Upon lapse of the first predetermined period of time $t_1$, the timer 90a acts to close the normally open switch 90b, and in turn, the relay coil Rw is energized to open the normally closed relay switch Wa and to close the normally open relay switch Wb. As a result, the controller 120 is deactivated. When the normally open relay switch Wb is closed, the timer 100a is activated to operate for the second predetermined period of time $t_2$, for instance four hours. In such a condition, the electric motors 10a, 30a and solenoid valve 80 each are maintained in a deenergized condition.

When the normally open switch 100b is closed under control of the timer 100a after lapse of the second predetermined period of time $t_2$, the relay coil Rx is energized to close the normally open relay switches Xa and Xd and to open the normally closed relay switches Xb and Xc. Simultaneously, the timer 110a is activated to operate for the third predetermined period of time $t_3$, for instance three minutes. Thus, the relay coil Rz is energized to close the normally open relay switch Z thereby to activate the electric motor 10a for compressor 10, while the solenoid valve 80 is energized to supply therethrough the hot gas under high pressure outflowing from the compressor 10 directly into the evaporator coil 70. In this instance, the liquid refrigerant confined in the evaporator coil 70 is vaporized by the hot gas and circulated as a gaseous refrigerant into the compressor 10 through the return line $P_1$.

When the normally open switch 110b is closed under control of the timer 110a after lapse of the third predetermined period of time $t_3$, the relay coil Ry is energized to open the normally closed switch Y. As a result, the timer 100a is deactivated to open the associated switch 100b, and in turn, the timer 110a is deactivated to open the associated switch 110b. Simultaneously, the relay coil Rx is deenergized to open the associated relay switches Xa and Xd. In this instance, the relay coil Rz is deenergized to open the associated relay switch Z thereby to deenergize the electric motor 10a for compressor 10, while the solenoid valve 80 is deenergized to cut off the supply of the hot gas into the evaporator coil 70 from the compressor 10. At the time when the timer 110a has been deactivated, the relay coil Ry is deenergized to close the associated relay switch Y, and in turn, the timer 100a is activated to operate for the second predetermined period of time $t_2$. During operation of the timer 100a, the above-described operation will be repeated.

From the above description, it will be understood that the solenoid valve 80 is energized under control of the timer 110a for the third predetermined period of time $t_3$ (for instance, three minutes) upon each lapse of the second predetermined period of time $t_2$ (for instance, four hours) measured by the timer 100a in a condition where the detection switch SW is being closed. During energization of the solenoid valve 80, the liquified refrigerant confined in the evaporator coil 70 is vaporized by the hot gas supplied from the compressor 10 and circulated as a gaseous refrigerant into the compressor 10 through the return line $P_1$. When the detection switch SW is opened, the timer 90*a* is deactivated to maintain the associated switch 90*b* in its open position, and the relay coil Rw is deenergized to close the associated relay switch Wa and open the associated relay switch Wb. Thus, the relay coil Rz is energized under control of the controller 120 to close the associated relay switch Z thereby to energize the electric motor 10*a* for compressor 10, while the electric motor 30*a* for cooling fan 30 is also energized under control of the controller 120. In this instance, the solenoid valve 80 is maintained in its deenergized condition. During the freezing cycle caused by the above action, the liquified refrigerant flowing into the compressor 10 is minimized. This is useful to protect the compressor 10 from unexpected trouble caused by liquified refrigerant from the evaporator coil 70 and to enhance the freezing performace of the freezer machine.

Having now fully set forth a preferred embodiment of the concept underlying the present invention, various modifications and variations of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A freezer machine having a refrigeration system in the form of a circulation circuit including a compressor, a condenser, an evaporator coil arranged for thermal exchange with a freezing receptacle, and a solenoid valve of the normally closed type disposed within a bypass circuit of said circulation circuit to supply therethrough the hot gas outflowing from said compressor directly into said evaporator coil when it has been energized, wherein an electric control circuit for the freezer machine comprises means for activating said compressor at least one time upon lapse of a predetermined period of time after said compressor has been deactivated and means for energizing said solenoid valve in response to activation of the compressor.

2. A freezer machine having a refrigeration system in the form of a circulation circuit including a compressor, a condenser, an evaporator coil arranged for thermal exchange with a freezing receptacle, and a solenoid valve of the normally closed type disposed within a bypass circuit of said circulation circuit to supply therethrough the hot gas outflowing from said compressor directly into said evaporator coil when it has been energized, wherein an electric control circuit for the freezer machine comprises first means for repeatedly measuring a first predetermined period of time in a condition where said compressor is being deactivated, second means for measuring a second predetermined period of time upon each lapse of the first predetermined period of time, and third means for activating said compressor for the second predetermined period of time upon each lapse of the first predetermined period of time and for energizing said solenoid valve in response to activation of said compressor.

* * * * *